US006271821B1

(12) United States Patent
Sung et al.

(10) Patent No.: US 6,271,821 B1
(45) Date of Patent: Aug. 7, 2001

(54) INTERFACE FOR LIQUID CRYSTAL DISPLAY

(75) Inventors: Jun-Ho Sung; Seong-Eun Chung, both of Seoul (KR)

(73) Assignee: SamSung Electronics Co., Ltd., Suwon (KR)

( * ) Notice: Subject to any disclaimer, the term of this patent is extended or adjusted under 35 U.S.C. 154(b) by 0 days.

(21) Appl. No.: 09/207,588

(22) Filed: Dec. 8, 1998

(30) Foreign Application Priority Data

Dec. 8, 1997 (KR) ..... 1997-66792

(51) Int. Cl.[7] ..... G09G 3/36

(52) U.S. Cl. ..... 345/98; 345/3; 345/94; 345/99; 345/100; 345/103; 345/87; 345/202; 345/213

(58) Field of Search ..... 345/98, 103, 132, 345/99, 100, 87, 94, 202, 213, 3

(56) References Cited

U.S. PATENT DOCUMENTS

| | | | | |
|---|---|---|---|---|
| 5,387,923 | | 2/1995 | Mattison et al. | 345/103 |
| 5,537,128 | | 7/1996 | Keene et al. . | |
| 5,617,113 | | 4/1997 | Prince | 345/103 |
| 5,900,857 | * | 7/1999 | Kuwata et al. | 345/98 |
| 5,929,832 | * | 7/1999 | Furukawa et al. | 345/98 |
| 6,014,126 | * | 7/1999 | Nishihara | 345/132 |
| 6,037,925 | * | 7/1999 | Kim | 345/213 |
| 6,040,828 | * | 3/2000 | Park | 345/213 |

FOREIGN PATENT DOCUMENTS

| | | |
|---|---|---|
| 19716095A | 11/1997 | (DE) . |
| 0291252A | 11/1988 | (EP) . |
| 0682334A | 11/1995 | (EP) . |
| 0881621A | 12/1998 | (EP) . |
| 2315180A | 1/1998 | (GB) . |

* cited by examiner

*Primary Examiner*—Richard Hjerpe
*Assistant Examiner*—Ali Zamani
(74) *Attorney, Agent, or Firm*—Robert E. Bushnell, Esq.

(57) ABSTRACT

A liquid crystal display (LCD) interface for communicating a video signal to an LCD comprises a video input device for separating the video signal into a synchronizing signal and R (Red), G (Green) and B (Blue) video signals having a resolution of m rows by n columns, a controller for generating a first clock frequency, a second clock frequency and a third clock frequency being half the second clock frequency based on the synchronizing signal, an R signal converter for dividing the frequency of the R video signal by four according to the first clock frequency to sequentially generate two adjacent pixel column data simultaneously starting both from the first pixel row and the $((m/2)+1)^{st}$ pixel row respectively to the $(m/2)^{th}$ pixel row and $m^{th}$ pixel row according to the second clock frequency fo so that the four pixel data arranged in the adjacent pixel columns are simultaneously generated, a G signal converter for dividing the frequency of the G video signal by four according to the first clock frequency to sequentially generate two adjacent pixel column data simultaneously starting both from the first pixel row and the $((m/2)+1)^{st}$ pixel row respectively to the $(m/2)^{th}$ pixel row and $m^{th}$ pixel row according to the second clock frequency fo so that the four pixel data arranged in the adjacent pixel columns are simultaneously generated, a B signal converter for dividing the frequency of the B video signal by four according to the first clock frequency to sequentially generate two adjacent pixel column data simultaneously starting both from the first pixel row and the $((m/2)+1)^{st}$ pixel row respectively to the $(m/_2)^{th}$ pixel row and $m^{th}$ pixel row according to the second clock frequency fo so that the four pixel data arranged in the adjacent pixel columns are simultaneously generated, and an LCD driver for supplying the pixel data from the R, G, B converters to an LCD panel.

9 Claims, 6 Drawing Sheets

(a)

| Resolution | Horizontal | | | Vertical | | | Sum | Blank Time Rate | Vf | Hf | Clk |
|---|---|---|---|---|---|---|---|---|---|---|---|
| | Back Porck | Sync | Front Porck | Back Porck | Sync | Front Porck | | % | [Hz] | [KHz] | [MHz] |
| 640 X 512 | 100 | 120 | 100 | 4 | 4 | 2 | 960 X 522 | 33.33 | 59.866 | 31.250 | 30 |

(b)

INTERFACE FOR LIQUID CRYSTAL DISPLAY

CLAIM OF PRIORITY

This application makes reference to, incorporates the same herein, and claims all benefits accruing under 35 U.S.C § 119 from an application entitled Interface For Liquid Crystal Display earlier filed in the Korean Industrial Property Office on Dec. 8, 1997, and there duly assigned Serial No. 97-66792 by that Office.

FIELD OF THE INVENTION

The present invention concerns a video interface for communicating video data to an LCD (liquid crystal display) apparatus used in a computer, television, etc.

BACKGROUND OF THE INVENTION

In order to enhance the resolution of an LCD such as the thin film transistor type, i.e., TFT-LCD, it is required to increase the frequency of the data clock signal used in the drive IC for the LCD. However, this is limited by the charging characteristics of the LCD and the drive IC. Alternatively, there has been proposed other systems to enhance the resolution without increasing the frequency of the data clock, which includes a n-pixel/1-clock pulse system for driving n pixels per 1 clock pulse and a dual scan system for scanning the screen simultaneously with two lines. Meanwhile, it is also required to make the frame memory have the responsive speed of at least 160 MHz and the storage capacity of 3.9 Mytes to obtain the display resolution of SXGA (super extended graphics array) order, for example, 1280×1024. Nevertheless, the responsive speed of the conventional frame memory is limited to 50 MHz.

Referring to FIG. 1, there are shown a plurality of frame memory blocks and multiplexers constituting a conventional interface for communicating R (Red) video data to the TFT-LCD of the dual scan system. In operation, the input video signal is firstly stored into the frame memories 11 to 18, and then divided into an upper side image part and a lower side image part applied to the TFTLCD (not shown). During this application, it is necessary to consider the responsive speed of the drive IC (integrated circuit) of the LCD and the gate pulse duration required for sufficiently charging the liquid crystals. In this case, the conventional interface requires 24 frame memories to process a least number of video data by dividing the frequency of the video signal by four and dual scanning according to Equation 1, as follows:

$$24=4\ \text{(frequency dividing)}\times 2\text{(Dual Scan)}\times 3\text{(RGB 3 Colors)} \quad (1)$$

In this case, each frame memory requires the storage capacity of 167 KBytes. Since the memories commercially available have the storage capacities of 130, 260, 330 or 520 KBytes, the memory with the storage capacity of 260 KBytes may be used as the frame memory. Hence, if the 24 frame memories each having 260 KBytes are used to constitute the total storage capacity to process the video data, there occurs a memory loss of 2.4 MBytes which is the difference between the required storage capacity 3.9 MBytes and the total storage capacity 6.3 MBytes.

Other known systems to drive a dual scan LCD, incorporated herein by reference, are exemplified by U.S. Pat. No. 5,387,923 to Phillip E. Mattison, et al. entitled VGA Controller UsingAddress Translation To Drive A Dual Scan LCD Panel And Method Therefor; U.S. Pat. No. 5,537,128 to David Keene, et al. entitled Shared Memory For Split-Panel LCD Display Systems; and U.S. Pat. No. 5,617,113 to Dennis W. Prince entitled Memory Configuration For Display Information.

SUMMARY OF THE INVENTION

It is an object of the present invention to provide an LCD interface for communicating the video signal to the LCD, which may optimize the storage capacity, divide the frequency of the video signal by four and generate 2 pixels per a single clock pulse in the dual scan system.

According to an embodiment of the present invention, an LCD interface for communicating a video signal to an LCD comprises a video input device for separating the video signal into a synchronizing signal and R (Red), G (Green) and B (Blue) video signals having a resolution of m rows by n columns, a controller for generating a first clock frequency, a second clock frequency and a third clock frequency being half the second clock frequency based on the synchronizing signal, a R signal converter for dividing the frequency of the R video signal by four according to the first clock frequency to sequentially generate two adjacent pixel column data simultaneously starting both from the first pixel row and the $((m/2)+1)^{st}$ pixel row respectively to the $(m/2)^{th}$ pixel row and m pixel row according to the second clock frequency fo so that the four pixel data arranged in the adjacent pixel columns are simultaneously generated, a G signal converter for dividing the frequency of the G video signal by four according to the first clock frequency to sequentially generate two adjacent pixel column data simultaneously starting both from the first pixel row and the $((m/2)+1)^{st}$ pixel row respectively to the $(m/2)^{th}$ pixel row and $m^{th}$ pixel row according to the second clock frequency fo so that the four pixel data arranged in the adjacent pixel columns are simultaneously generated, a B signal converter for dividing the frequency of the B video signal by four according to the first clock frequency to sequentially generate two adjacent pixel column data simultaneously starting both from the first pixel row and the $((m/2)+1)^{st}$ pixel row respectively to the $(m/2)^{th}$ pixel row and $m^{th}$ pixel row according to the second clock frequency fo so that the four pixel data arranged in the adjacent pixel columns are simultaneously generated, and an LCD driver for supplying the pixel data from the R G, B converters to an LCD panel.

Preferably, each of the R, G, B converters comprises a first frame memory having a matrix of data storage cells arranged in j rows (m/4)×k columns (n) to store the first group of pixels obtained by dividing by four the m×n pixel data from the video input device, a second frame memory having a matrix of data storage cells arranged in j rows (m/4)×k columns (n) to store the second group of pixels obtained by dividing by four the m×n pixel data from the video input device, a third frame memory having a matrix of data storage cells arranged in j rows (m/4)×k columns (n) to store the third group of pixels obtained by dividing by four the m×n pixel data from the video input device, a fourth frame memory having a matrix of data storage cells arranged in j rows (m/4)×k columns (n) to store the fourth group of pixels obtained by dividing by four the m×n pixel data from the video input device, a first line memory for storing the line data of the odd-numbered pixel data rows of the first frame memory according to the second clock frequency and for outputting the stored pixel data according to the third clock frequency, a second line memory for storing the line data of the odd-numbered pixel data rows of the first frame memory according to the second clock frequency and for outputting the stored pixel data according to the third clock frequency, a third line memory for storing the line data of the odd-numbered pixel data rows of the third frame memory according to the second clock frequency and for outputting the stored pixel data according to the third clock frequency, a fourth line memory for storing the line data of the odd-numbered pixel data rows of the fourth frame memory according to the second clock frequency and for outputting the stored pixel data according to the third clock frequency, a first multiplexer for selectively receiving the pixel data output from the first or third line memory and outputting the pixel data of the first or third line memory according to the second clock frequency, a second multiplexer for selectively receiving the pixel data output from the second or fourth line memory and outputting the pixel data of the second or fourth line memory according to the second clock frequency, a third multiplexer for selectively receiving the pixel data of the even-numbered data rows output from the first or third frame memory and outputting the pixel data of the even-numbered data rows of the first or third frame memory according to the second clock frequency, and a fourth multiplexer for selectively receiving the pixel data of the even-numbered data rows output from the second or fourth frame memory and outputting the pixel data of the even-numbered data rows of the second or fourth frame memory according to the second clock frequency. Preferably, the resolution is 640×512, the first clock frequency 6 to 40 MHz, the second clock frequency 30 MHz and the third clock frequency 15 MHz.

BRIEF DESCRIPTION OF THE ATTACHED DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
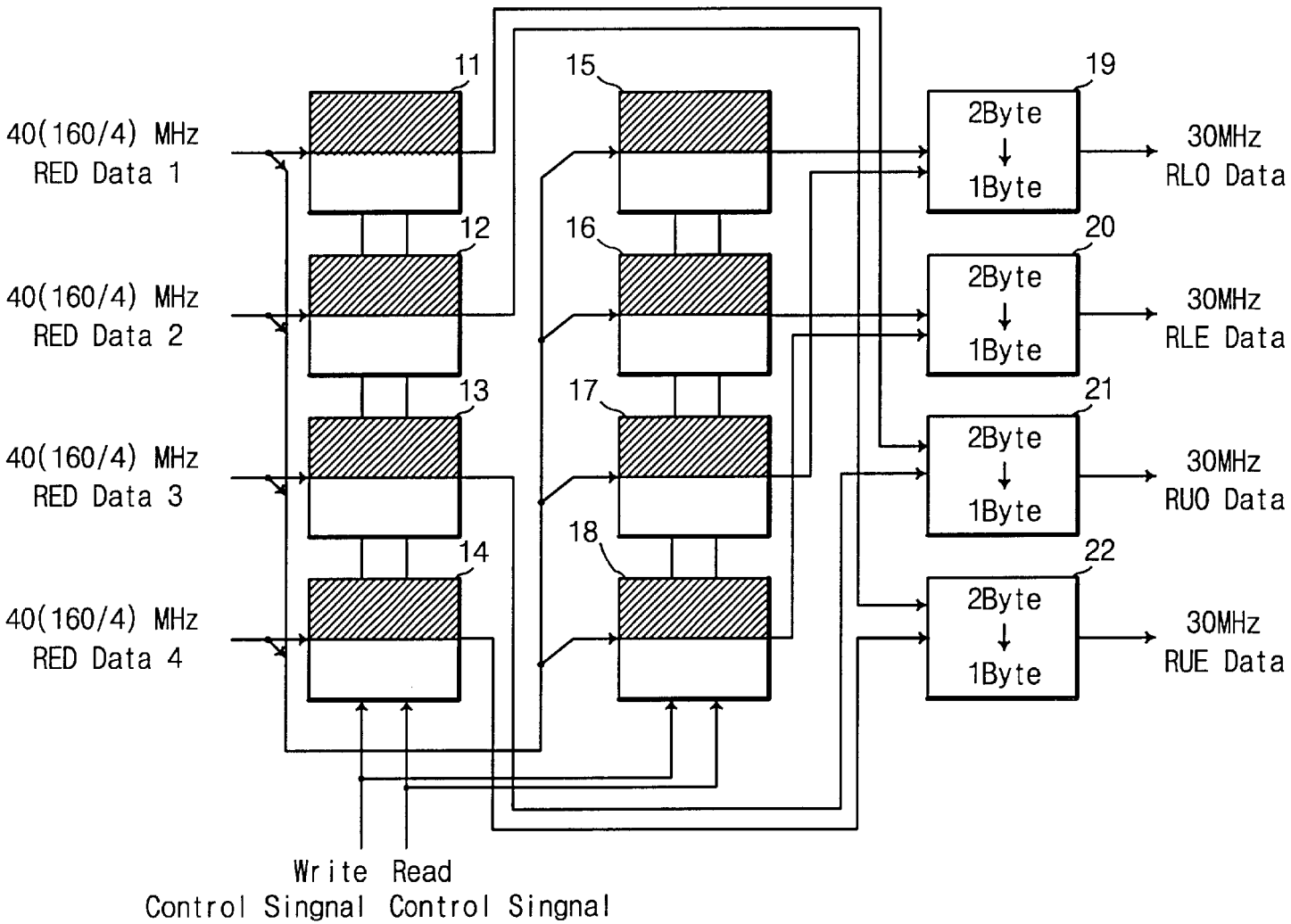
FIG. 1 is a block diagram for illustrating the memory blocks and multiplexers of a conventional LCD interface to interface R signal data with the LCD panel.
Figure 2:
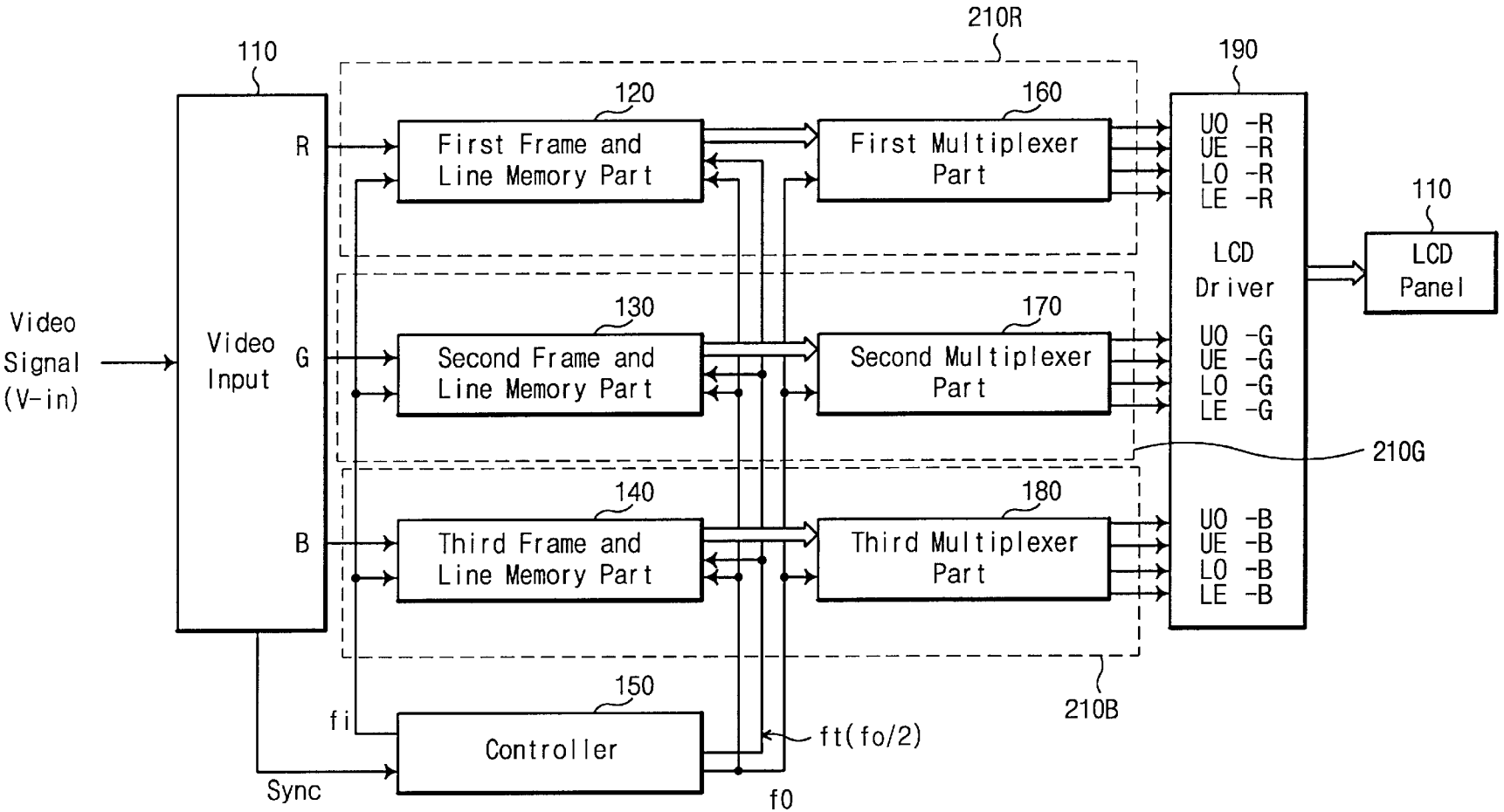
FIG. 2 is a block diagram for illustrating an LCD interface according to the present invention.
Figure 3:
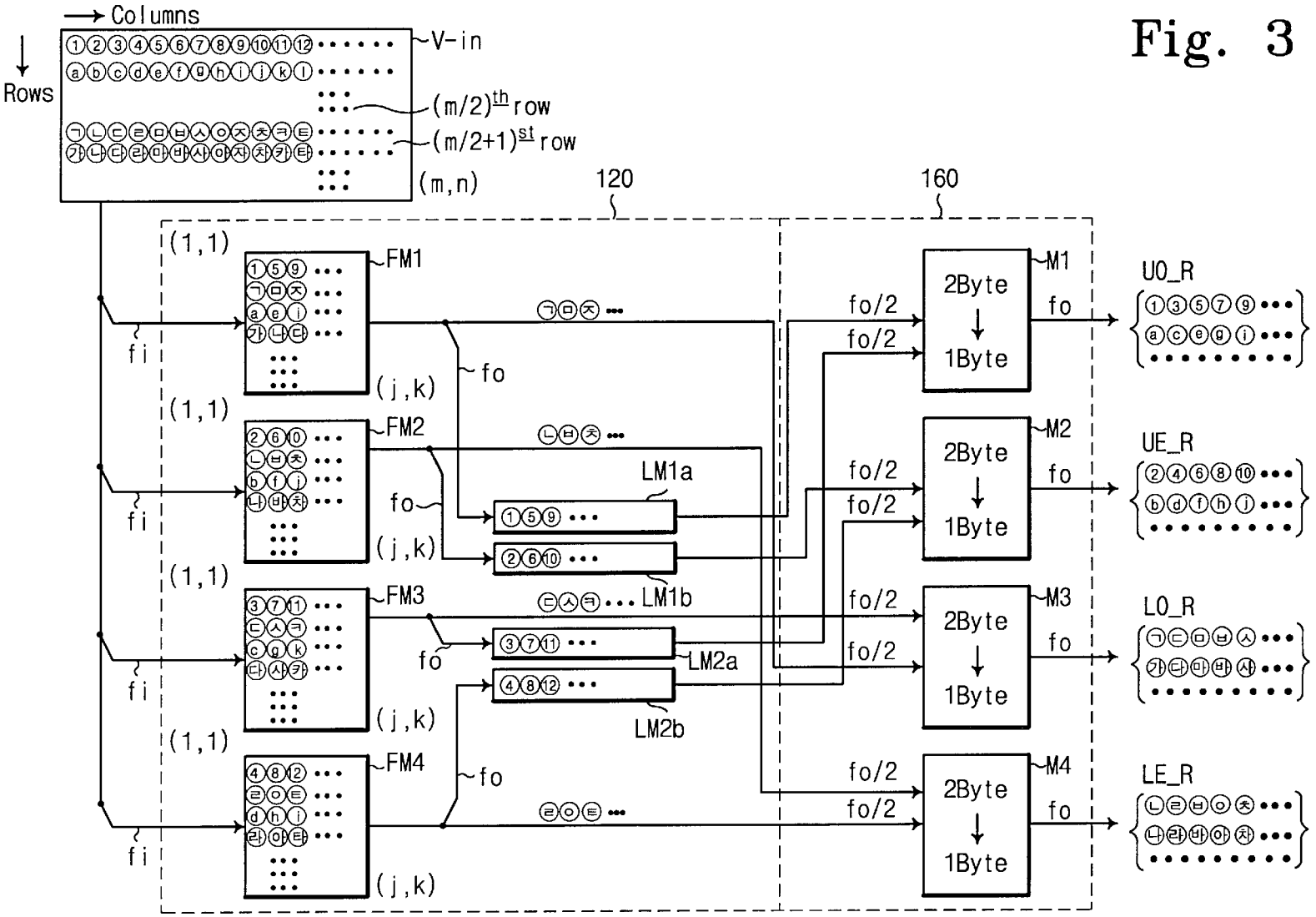
FIG. 3 is a block diagram for illustrating the structure of the signal converters as shown in FIG. 2, and the data interfacing.
Figure 4:
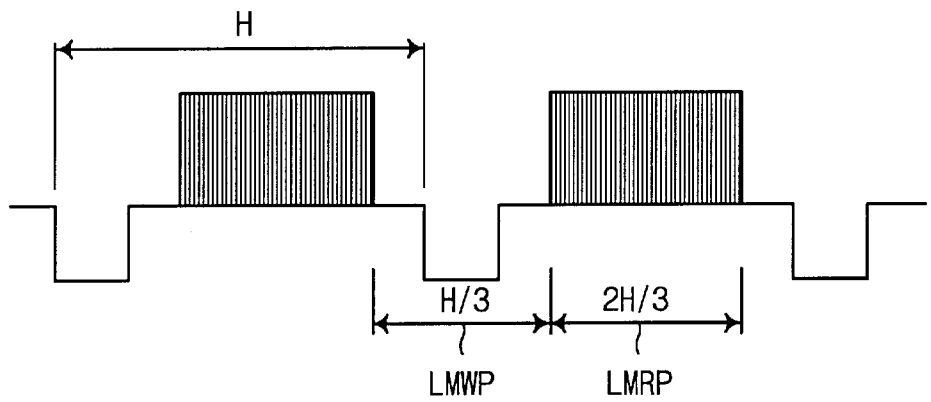
FIGS. 4A and 4B illustrate the relationship between the active time of the video data and the write operation of the line memory according to resolution.

Referring to FIGS. 2 to 6, an LCD interface for communicating a video signal to an LCD panel 200 includes a video input device 110, R signal converter 210R, G signal converter 210G, B signal converter 210B, controller 150, and LCD driver 190, as shown in FIG. 2. In the present invention, the frame memories as shown in FIG. 1 are partly replaced by line memories to optimize the total storage capacity and thus reduce the production cost. Each of the R, G and B converters 210R, 210G and 210B is constructed as shown in FIG. 3, which depicts the R converter 210R.

The input video signal V-in is separated by the video input device (for example, ADC (analog-to-digital converter) and PLL (phase locked loop)) 110 into R, G and B color signals and a synchronizing signal Sync. The R color signal, for example, is processed by a first frame and line memory part 120, applied through a first multiplexer part 160 to the LCD driver 190. The input/output clock frequencies fi, ft, fo of the frame and line memory parts 120, 130 and 140 and the operational clock frequency fo of the multiplexer parts 160, 170 and 180 are controlled by the controller 150.

The video signal from the first multiplexer part 160 is separated into four frame part signals applied to the LCD driver, which are an upper frame part odd-numbered pixel signal UO_R, upper frame part even-numbered pixel signal UE_R, lower frame part odd-numbered pixel signal LO_R and lower frame part even-numbered pixel signal LE_R. Meanwhile, the write clock frequency fi of the first frame and line memory part 120 may be adjusted in the range of 6 to 40 MHz to perform the multisync function to accommodate various video formats and frequencies. In order to process the video frequencies in the range of 6 to 40 MHz, the responsive speed of the frame memory should be at least 40 MHz in writing. In addition, the clock frequency fo of the data generated from the multiplexer part 160 is, for example, 30 MHz. The TFT-LCD shows most excellent picture quality at a vertical frequency of 55 to 60 Hz, and therefore, it is required to convert the input video signal into a video data of a given frequency (vertical frequency of about 60 Hz; data clock frequency of 120 MHz). The data clock frequency of 120 MHz is divided by four to produce 30 MHz in the 2 pixels/1 clock pulse and dual scan system. Also the data clock frequency fo/2 directly delivered from the frame memory to the multiplexer part is, for example, 15 MHz while the data clock frequency delivered from the frame memory to the line memory is, for example, 30 MHz.

Describing the transmission format of the pixel data of the input video signal V-in and the output thereof with reference to FIG. 3, the input video signal is arranged in a matrix of m rows and n columns, of which the frame part covered from the first row to the $(m/2)^{th}$ row is defined as the upper frame part, and the frame part from the $(m/2)^{th}$ row to the $m^{th}$ row as the lower frame part. The first frame and line memory part 120 comprises four frame memories FM1 to FM4 and four line memories LM1*a*, LM1*b*, LM2*a*, LM2*b*. The first multiplexer part 160 comprises four multiplexers M1 to M4.

The video data is written in the first to the fourth frame memories as follows:

The first row of pixel data of the upper frame part are divided by four starting from the first column pixel data, written into the first row of the first frame memory FM1 in such a sequence as the first pixel data 1, the fifth pixel data 5, the ninth pixel data 9. Then, the first row pixel data of the lower frame part are divided by four starting from the first column pixel data, written into the second row of the first frame memory FM1 in such a sequence as the first column pixel data, the fifth column pixel data, the ninth column pixel data, . . . . In this way, the row pixel data are successively written into the rows of the first frame memory FM1 alternately supplied from the upper and lower frame parts. The first frame memory FM1 is arranged in the form of a matrix consisting of j rows and k columns. Meanwhile, if the input video signal has a resolution of 640×512, each of the four frame memories is sufficient to have 160×512 cells by dividing the resolution by four.

Similarly, in the second frame memory FM2, the first row pixel data of the upper frame part are divided by four, but in this case starting from the first column pixel data, written into the first row of the second frame memory FM2 in such a sequence as the second pixel data 2, the sixth pixel data 6, the tenth pixel data 10, . . . . Then, the first row pixel data of the lower frame part are divided by four starting from the second column pixel data, written into the second row of the second frame memory FM2 in such a sequence as the second column pixel data, the sixth column pixel data, the tenth column pixel data . . . . In this way, the row pixel data are successively written into the rows of the second frame memory FM2 alternately supplied from the upper and lower frame parts. Likewise, the third and fourth frame memories FM3 and FM4 are also written sequentially with the row pixel data of the upper and lower frame parts. Further, the pixel data of the odd-numbered rows of the first to fourth frame memories FM1 to FM4 are respectively transferred to the first to fourth line memories LM1*a*, LM1*b*, LM2*a*, LM2*b*.

The first multiplexer M1 selectively receives and outputs the pixel data of the first or third line memory LM1*a* or LM2*a* receiving the pixel data of the odd-numbered rows of the first or third frame memory FM1 or FM3 while the second multiplexer M2 selectively receives and outputs the pixel data of the second or fourth line memory LM1*b* or LM2*b* receiving the pixel data of the odd-numbered rows of the second or fourth frame memories FM2 and FM4. In addition, the third multiplexer M3 selectively receives and outputs the pixel data of the even-numbered rows of the first or third frame memory FM1 or FM3 while the fourth multiplexer M4 selectively receives and outputs the pixel data of the even-numbered rows of the second or fourth frame memory FM2 or FM4. As is evident from the above, each of the four multiplexers M1 to M4 receives 2-Byte data from two of the frame and line memories. Thus, as shown in FIG. 3, the first multiplexer M1 provides the upper frame part odd-numbered pixel data UO_R, the second multiplexer M2 provides the upper frame part even-numbered pixel data UE_R, the third multiplexer M3 provides the lower frame part odd-numbered pixel data LO_R, and the fourth multiplexer M4 provides the lower frame part even-numbered pixel data LE_R. More specifically, the multiplexers M1 to M4 simultaneously generate the pixel data one by one starting from the first pixel data of the first row to the last pixel data of the last row, so that the first two adjacent pixel data 1, 2, ¬, ⊢ in the first rows of the upper and lower frame parts are transferred at the first time point, the second adjacent pixel data 3, 4, ⊏, ⊐ in the second rows of the upper and lower frame parts at the second time point, and so on.

Figure 6:
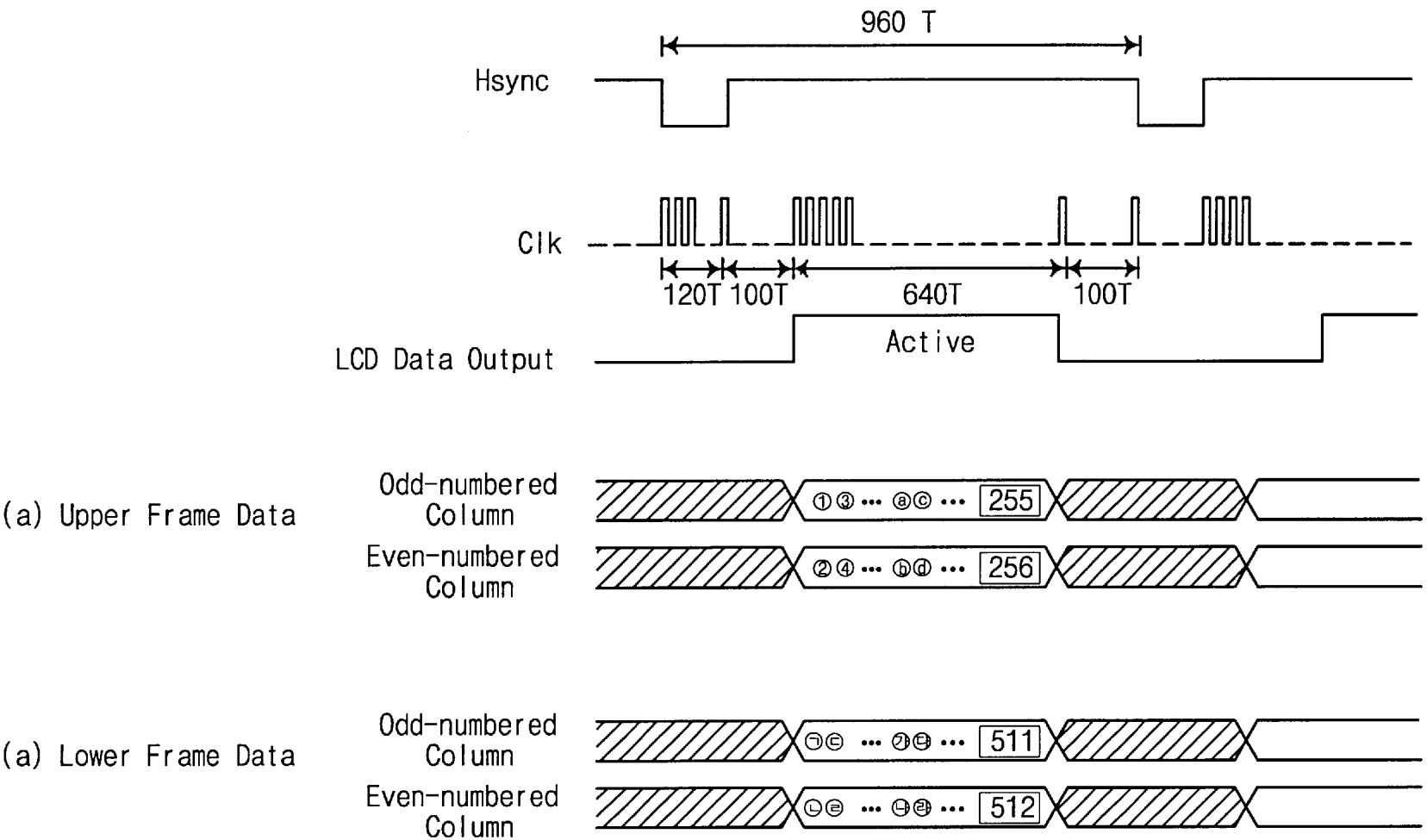
FIG. 6 is a diagram for illustrating the data transmission with respect to the synchronization time in 640×512 mode as shown in FIG. 4.

Referring to FIG. 4A and FIG. 6, a vertical frequency Vf of a video signal having a resolution of 640×512 is 59.866 Hz, the horizontal frequency Hf is 31.250 KHz, the data clock frequency Clk is 30 MHz, the blank time rate is 33.33%. Therefore, in the horizontal synchronous interval, the width of the back porch can contain the numbers of 100 data clocks, the width of the synchronous signal Sync can contain the numbers of 120 data clocks, and the width of the front porch can contain the numbers of 100 data clocks. In the vertical interval, the width of the back porch can contain the numbers of 4 data clocks, the width of the synchronous signal Sync can contain the numbers of 4 data clocks, and the width of the front porch can contain the numbers of 2 data clocks. In each frame, the numbers of 640×512 data clocks are used as the active period. The sum of the data clocks used in one frame is (640+100+120+100)×(512+4+4+2)=960×522. As shown in FIG. 4B, the R, G, B signal converters generate the video data according to the horizontal signal, where the data are written in the line memories in the line memory write period (LMWP) H/3 when there is no active data, and the data are read from the line memories in the line memory read period (LMRP) 2H/3.

Figure 5:
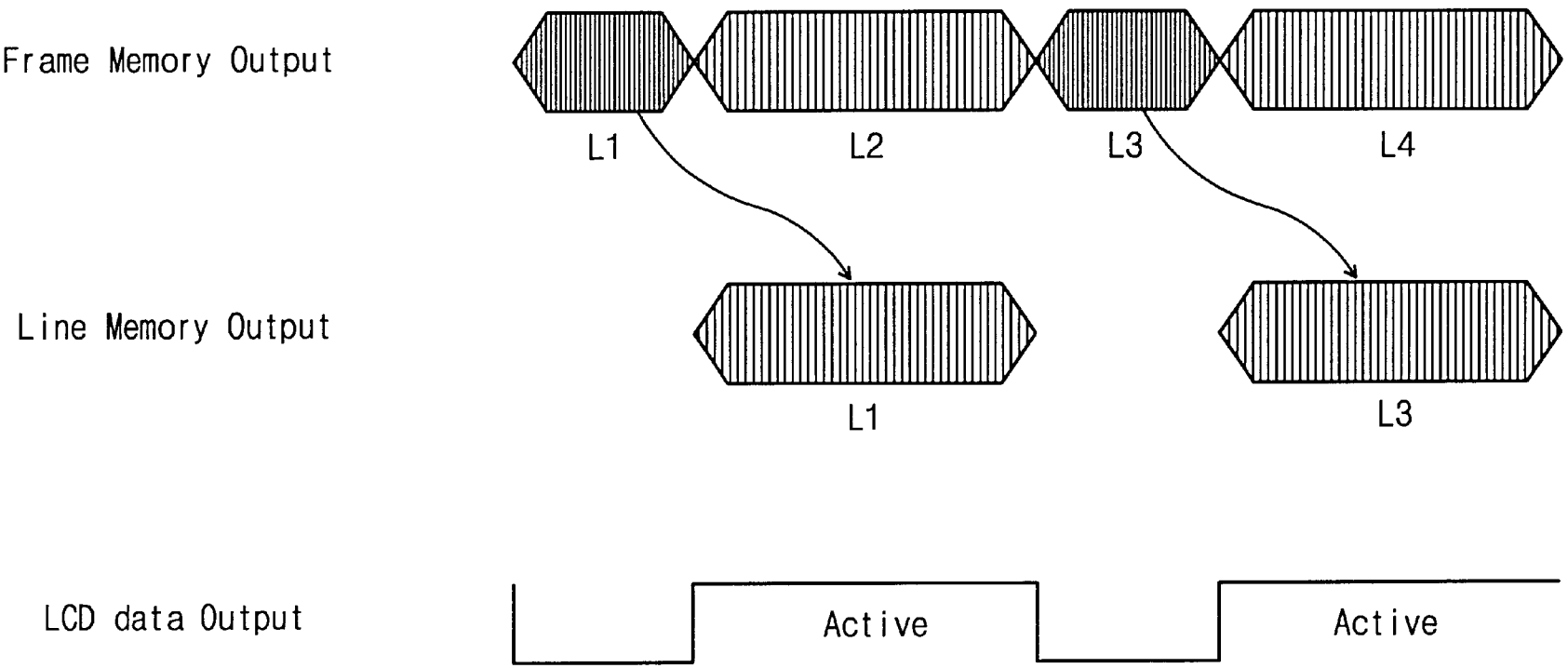
FIG. 5 is a diagram for illustrating the relationship between the outputs of the frame memories, line memories and LCD data in FIG. 3.

Referring to FIG. 5, the data output operation of the frame memories is performed in the active period L2, L4 while the line memories are written by the frame memories in the non-active period L1, L3. Referring further to FIG. 6, the clock pulse 640T defines the active period, where the video data both in the odd-numbered and even-numbered columns of the upper and lower frame parts are simultaneously generated. The non-active periods L1 and L3 refer to, for example, the horizontal blanking interval, and the data is read from the frame memories FM1–FM4 at the frequency fo and the data is then stored in the line memories LM1–LM4 at the frequency fo. During the active period, it data is read from the frame memories FM1–FM4 and line memories LM1–LM4 at the frequency fo/2 and supplied to the multiplexers M1–M4.

The CRT display employing the electron beam scanning requires the blanking time during which the electron beam returns to the original position after scanning one frame. However, the TFT-LCD does not require the blanking time because its pixels are driven by theirs respective drive transistors. The present invention utilizes the blanking time and the line memories to reduce the number and capacity of the frame memories. For example, 12 expensive frame memories may be replaced by 6 cheap line memories in the inventive LCD interface.

While the present invention has been described in connection with the specific embodiments accompanied by the attached drawings, it will be readily appreciated by those skilled in the art that various changes and modifications may be made without departing the gist of the present invention.

What is claimed is:

1. A liquid crystal display (LCD) interface for communicating a video signal to an LCD comprising:

a video input device for separating said video signal into a synchronizing signal and R (Red), G (Green) and B (Blue) video signals having a resolution of m rows by n columns;

a controller for generating a first clock frequency, a second clock frequency and a third clock frequency, said third clock frequency being half said second clock frequency based on said synchronizing signal;

a R signal converter for dividing the frequency of said R video signal by four according to said first clock frequency to sequentially generate two adjacent pixel column data simultaneously starting both from the first pixel row and the $((m/2)+1)^{st}$ pixel row respectively to the $(m/2)^{th}$ pixel row and $m^{th}$ pixel row according to said second clock frequency so that the four pixel data arranged in the adjacent pixel columns are simultaneously generated;

a G signal converter for dividing the frequency of said G video signal by four according to said first clock frequency to sequentially generate two adjacent pixel column data simultaneously starting both from the first pixel row and the $((m/2)+1)^{st}$ pixel row respectively to the $(m/2)^{th}$ pixel row and $m^{th}$ pixel row according to said second clock frequency so that the four pixel data arranged in the adjacent pixel columns are simultaneously generated;

a B signal converter for dividing the frequency of said B video signal by four according to said first clock frequency to sequentially generate two adjacent pixel column data simultaneously starting both from the first pixel row and the $((m/2)+1)^{st}$ pixel row respectively to the $(m/2)^{th}$ pixel row and $m^{th}$ pixel row according to said second clock frequency so that the four pixel data arranged in the adjacent pixel columns are simultaneously generated; and an LCD driver for supplying the pixel data from said R, G, B converters to an LCD panel.

2. The LCD interface as set forth in claim 1, wherein each of said R, G, B converters comprises:

a first frame memory having a matrix of data storage cells arranged in j rows (m/4)×k columns (n) to store the first group of pixels obtained by dividing by four the m×n pixel data from said video input device;

a second frame memory having a matrix of data storage cells arranged in j rows (m/4)×k columns (n) to store the second group of pixels obtained by dividing by four the m×n pixel data from said video input device;

a third frame memory having a matrix of data storage cells arranged in j rows (m/4)×k columns (n) to store the third group of pixels obtained by dividing by four the m×n pixel data from said video input device;

a fourth frame memory having a matrix of data storage cells arranged in j rows (m/4)×k columns (n) to store the fourth group of pixels obtained by dividing by four the m×n pixel data from said video input device;

a first line memory for storing the line data of the odd-numbered pixel data rows of said first frame memory according to said second clock frequency and outputting the stored pixel data according to said third clock frequency;

a second line memory for storing the line data of the odd-numbered pixel data rows of said second frame memory according to said second clock frequency and outputting the stored pixel data according to said third clock frequency;

a third line memory for storing the line data of the odd-numbered pixel data rows of said third frame memory according to said second clock frequency outputting the stored pixel data according to said third clock frequency;

a fourth line memory for storing the line data of the odd-numbered pixel data rows of said fourth frame memory according to said second clock frequency and outputting the stored pixel data according to said third clock frequency;

a first multiplexer for selectively receiving and outputting the pixel data of said first and third line memories according to said second clock frequency;

a second multiplexer for selectively receiving and outputting the pixel data of said second and fourth line memories according to said second clock frequency;

a third multiplexer for selectively receiving and outputting the pixel data of the even-numbered data rows of said first and third frame memories according to said second clock frequency; and a fourth multiplexer for selectively receiving and outputting the pixel data of the even-numbered data rows of said second and fourth frame memories according to said second clock frequency.

3. The LCD interface as set forth in claim 1, wherein said resolution is 640×512, said first clock frequency is 6 to 40 MHz, said second clock frequency is 30 MHz and said third clock frequency is 15 MHz.

4. A liquid crystal display (LCD) interface for communicating a video signal to an LCD comprising:

a video input device for separating said video signal into a synchronizing signal and R (Red), G (Green) and B (Blue) video signals having a resolution of m rows by n columns;

a controller for generating a first clock frequency, a second clock frequency and a third clock frequency, said third clock frequency being half said second clock frequency based on said synchronizing signal;

first, second and third signal converters, each of said first, second and third signal converters being responsive to said first, second and third clock frequencies, each of said first, second and third signal converters receiving a respective one of said R, G and B video signals, dividing a frequency of the respective one of said R, G and B video signals by four and sequentially outputting adjacent first and second pixel column data simultaneously, wherein said first pixel column data corresponds to pixel data between the first pixel row and the $(m/2)^{th}$ pixel row and said second pixel column data corresponds to pixel data between the $((m/2)+1)^{st}$ pixel row and the and $m^{th}$ pixel row; and an LCD driver for supplying the adjacent first and second pixel column data from said first, second and third signal converters to an LCD panel.

5. The LCD interface as set forth in claim 4, wherein each of said first, second and third signal converters comprises:

a first frame memory having a matrix of data storage cells arranged in j rows×k columns to store the first group of pixels obtained by dividing by four the m×n pixel data from said video input device, where j is equal to m/4 and k is equal to n;

a second frame memory having a matrix of data storage cells arranged in j rows×k columns to store the second group of pixels obtained by dividing by four the m×n pixel data from said video input device;

a third frame memory having a matrix of data storage cells arranged in j rows×k columns to store the third group of pixels obtained by dividing by four the m×n pixel data from said video input device;

a fourth frame memory having a matrix of data storage cells arranged in j rows×k columns to store the fourth group of pixels obtained by dividing by four the m×n pixel data from said video input device;

a first line memory for storing the line data of the odd-numbered pixel data rows of said first frame memory according to said second clock frequency and outputting the stored pixel data according to said third clock frequency;

a second line memory for storing the line data of the odd-numbered pixel data rows of said second frame memory according to said second clock frequency and outputting the stored pixel data according to said third clock frequency;

a third line memory for storing the line data of the odd-numbered pixel data rows of said third frame memory according to said second clock frequency outputting the stored pixel data according to said third clock frequency;

a fourth line memory for storing the line data of the odd-numbered pixel data rows of said fourth frame memory according to said second clock frequency and outputting the stored pixel data according to said third clock frequency;

a first multiplexer for selectively receiving and outputting the pixel data of said first and third line memories according to said second clock frequency;

a second multiplexer for selectively receiving and outputting the pixel data of said second and fourth line memories according to said second clock frequency;

a third multiplexer for selectively receiving the pixel data of the even-numbered data rows output from said first and third frame memories in response to said third clock frequency and outputting the pixel data of the even-numbered data rows of said first and third frame memories according to said second clock frequency; and a fourth multiplexer for selectively receiving the pixel data of the even-numbered data rows output from said second and fourth frame memories in response to said third clock frequency and outputting the pixel data of the even-numbered data rows of said second and fourth frame memories according to said second clock frequency.

6. The LCD interface as set forth in claim 4, wherein m is equal to 640 rows and n is equal to 512 columns, said first clock frequency is 6 to 40 MHz, said second clock frequency is 30 MHz and said third clock frequency is 15 MHz.

7. The LCD interface as set forth in claim 4, wherein said liquid crystal display is comprised of a thin film transistor LCD panel.

8. A method of communicating a video signal to a liquid crystal display, comprising the steps of:

separating said video signal into a synchronizing signal and R (Red), G (Green) and B (Blue) video signals having a resolution of m rows by n columns;

generating a first clock frequency, a second clock frequency and a third clock frequency, said third clock frequency being half said second clock frequency based on said synchronizing signal;

dividing a frequency of each of said R, G and B video signals by four and outputting sequential pixel data of adjacent first and second pixel column data simultaneously, wherein said first pixel column data corresponds to pixel data between the first pixel row and the $(m/2)^{th}$ pixel row and said second pixel column data corresponds to pixel data between the $((mn/2)+1)^{st}$ pixel row and the and $m^{th}$ pixel row, in response to said first, second and third clock frequencies; and supplying the adjacent first and second pixel column data to said liquid crystal display for display on a liquid crystal display panel.

9. The method as set forth in claim 8, wherein said step of dividing a frequency of each of said R, G and B video signals by four and outputting sequential pixel data of adjacent first and second pixel column data simultaneously, comprises the steps of:

storing, in response to said first clock frequency, said R video signals into first through fourth frame memories each having a matrix of data storage cells arranged in j rows×k columns to store the first group of pixels obtained by dividing by four the m×n pixel data from said video input device, where j is equal to m/4 and k is equal to n;

storing, in response to said first clock frequency, said G video signals into fifth through eighth frame memories each having a matrix of data storage cells arranged in j rows×k columns to store the first group of pixels obtained by dividing by four the m×n pixel data from said video input device, where j is equal to m/4 and k is equal to n;

storing, in response to said first clock frequency, said B video signals into ninth through twelfth frame memories each having a matrix of data storage cells arranged in j rows×k columns to store the first group of pixels obtained by dividing by four the m×n pixel data from said video input device, where j is equal to m/4 and k is equal to n;

outputting said R, G and B video signals from each of said first through twelfth frame memories in response to said second clock frequency during an inactive video period and in response to said third clock frequency during an active video period;

storing, in response to said second clock frequency and during said inactive video period, odd-numbered lines of said R video signals output from said first to fourth frame memories into respective first to fourth line memories;

storing, in response to said second clock frequency and during said inactive video period, odd-numbered lines of said G video signals output from said fifth to eighth frame memories into respective fifth to eighth line memories;

storing, in response to said second clock frequency and during said inactive video period, odd-numbered lines of said B video signals output from said ninth to twelfth frame memories into respective ninth to twelfth line memories;

outputting, in response to said third clock frequency and during said active video period, said odd-numbered lines of said R video signals from said first and third line memories to a first multiplexer;

outputting, in response to said third clock frequency and during said active video period, said odd-numbered lines of said R video signals from said second and fourth line memories to a second multiplexer;

supplying even-numbered lines of said R video signals output from said first and third frame memories to a third multiplexer during said active video period;

supplying even-numbered lines of said R video signals output from said second and fourth frame memories to a fourth multiplexer during said active video period;

outputting, in response to said third clock frequency and during said active video period, said odd-numbered lines of said G video signals from said fifth and seventh line memories to a fifth multiplexer;

outputting, in response to said third clock frequency and during said active video period, said odd-numbered lines of said G video signals from said sixth and eighth line memories to a sixth multiplexer;

supplying even-numbered lines of said G video signals output from said fifth and seventh frame memories to a seventh multiplexer during said active video period;

supplying even-numbered lines of said G video signals output from said sixth and eighth frame memories to an eighth multiplexer during said active video period;

outputting, in response to said third clock frequency and during said active video period, said odd-numbered lines of said B video signals from said ninth and eleventh line memories to a ninth multiplexer;

outputting, in response to said third clock frequency and during said active video period, said odd-numbered lines of said B video signals from said tenth and twelfth line memories to a tenth multiplexer;

supplying even-numbered lines of said B video signals output from said ninth and eleventh frame memories to a eleventh multiplexer during said active video period;

supplying even-numbered lines of said B video signals output from said tenth and twelfth frame memories to a twelfth multiplexer during said active video period; and outputting said R, B and G video signals from each of said first to twelfth multiplexers in response to said third clock frequency, for display on said liquid crystal display panel.

* * * * *